US005147219A

United States Patent [19]

Gilberts et al.

[11] Patent Number: 5,147,219

[45] Date of Patent: Sep. 15, 1992

[54] REUSABLE TERMINAL LOCKING CAP

[75] Inventors: Alexander G. Gilberts, Barrington Hills; Richard Kaczmarek, Chicago; Edward S. Paluch, Elmwood Park; Thomas G. Volk, Grayslake, all of Ill.

[73] Assignee: Reliance Comm/Tec Corporation, Chicago, Ill.

[21] Appl. No.: 704,708

[22] Filed: May 17, 1991

Related U.S. Application Data

[63] Continuation of Ser. No. 524,772, May 16, 1990.

[51] Int. Cl.[5] ..... H01R 4/22

[52] U.S. Cl. ..... 439/521; 174/138 F

[58] Field of Search ..... 439/521, 522; 429/65, 429/178, 179, 181, 183, 185; 174/138 F

[56] References Cited

U.S. PATENT DOCUMENTS

| | | | |
|---|---|---|---|
| 3,960,427 | 6/1976 | Piaget et al. | 439/521 |
| 4,420,213 | 12/1983 | Julian et al. | 439/522 |
| 4,483,910 | 11/1984 | Julian | 439/521 |
| 4,634,207 | 1/1987 | Debbaut | 339/116 C |
| 4,674,820 | 6/1987 | Foster et al. | 439/522 |
| 4,883,431 | 11/1989 | Uken et al. | 439/521 |

FOREIGN PATENT DOCUMENTS

| | | | |
|---|---|---|---|
| 2312866 | 12/1976 | France | 439/521 |

*Primary Examiner*—Larry I. Schwartz
*Assistant Examiner*—Kevin J. Carroll
*Attorney, Agent, or Firm*—Trexler, Bushnell, Giangiorgi & Blackstone, Ltd.

[57] ABSTRACT

A reusable cap for providing mechanical, electrical and environmental isolation of an electrical terminal. The cap includes a tubular body which has in it an opening for receiving the wire(s) connected to the terminal binding post. The tubular body has a neck. Seated in the neck is the mechanism for engaging the threads of the binding post. The mechanism, which is made of conductive material, is seated in the neck so as to be rotatable without causing rotation of the housing. The cap also includes a removable cover which can be placed over the mechanism. Removing the cover allows the binding post to be accessible through the mechanism for the purposes of testing.

7 Claims, 4 Drawing Sheets

44
54
19
52
50
46
48
10
26
34
32
25
22
24
20
16
17
18
12
13
14

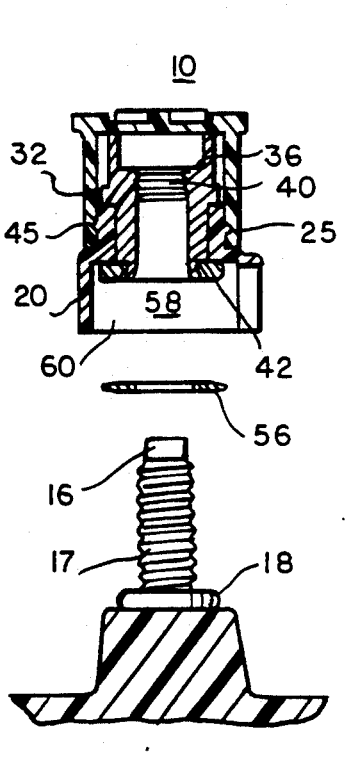
FIG.2
FIG.3
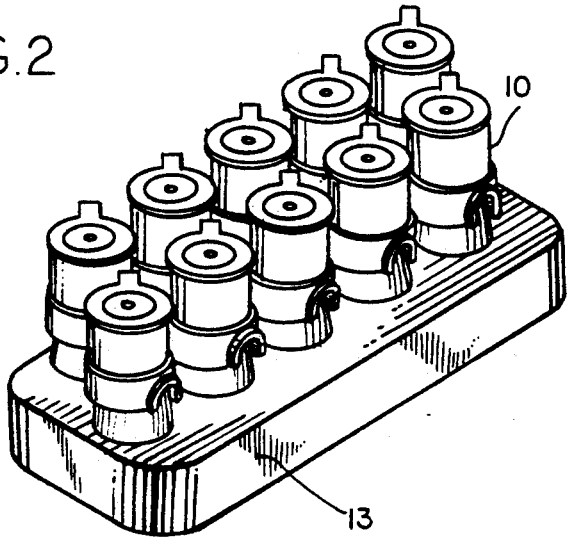
FIG.4a
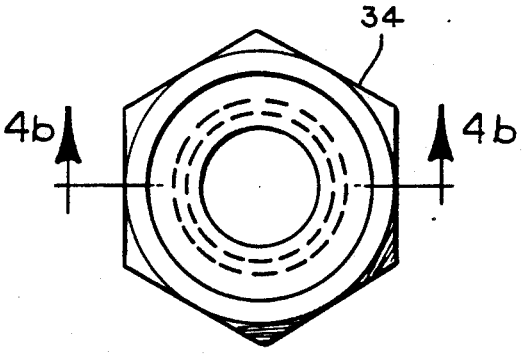
FIG.4b
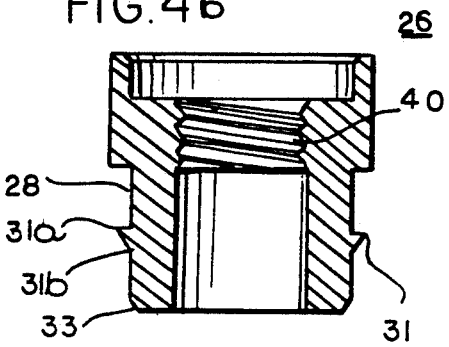

REUSABLE TERMINAL LOCKING CAP

This application is a continuation of application Ser. No. 524,772, filed May 16, 1990, now abandoned.

BACKGROUND OF THE INVENTION

1. Field of the Invention

This invention relates to protective caps for covering electrical terminals and more particularly, to such caps which are reusable, encapsulate the electrical terminals and also provide easy access to the terminals for testing without the necessity of removing the cap from the terminal.

2. Description of the Prior Art

Terminal blocks are used in the telecommunications industry in a wide variety of applications. The terminal blocks may include a threaded binding post to which the telephone wire is connected by a combination of nuts and washers. One example of such blocks are the A-line series of blocks sold by assignee's Reliable Electric/Utility Products operating unit. Quite typically, the terminal block may also be mounted inside of a suitable housing such as a pedestal or an aerial terminal. It has been found that such binding post terminal block designs are susceptible to corrosion in humid or corrosive environments.

One solution to overcome this susceptibility of the binding posts is to cover the binding post with an insulating cap which includes therein an encapsulant. One example of such a cap is shown in U.S. Pat. No. 4,634,207 (hereinafter the '207 patent). Another example of such a cap is shown in U.S. Pat. No. 4,674,820 (hereinafter the '820 patent).

The '207 patent shows in FIG. 1 one embodiment such a cap and in FIGS. 2A and 2B alternate embodiments therefor. In the embodiment of FIG. 1, the force means which ensures that the encapsulant is maintained in compressive contact with the binding post and substantially encapsulates the post is an element which is independent of the first means which contains the encapsulant. In the alternate embodiments, the force means is inherent in the first means.

In the alternate embodiment of FIG. 2A of the '207 patent, the force means is a split retaining nut which is integral to the housing which contains the encapsulant. The split retaining nut has an internal threaded portion that is complementary with the threads of the binding post. The nut is split so that it can be pushed axially onto the binding post without threading it. The nut is internally threaded so that it can grip the binding post upon cessation of the pushing action. In the alternate embodiment of FIG. 2B of the '207 patent, the force means is a uniblock device that fits over the entire terminal block.

The '820 patent shows a reusable terminal cap which includes a slot which is designed to be self tearing by the wire connected to the binding post as the cap is inserted over the wire. Struts are used interior to the cap to rigidify the cap's integral neck portion. The struts include a threaded or irregular surfaces which interact with the threads on the binding post as the cap is pressed onto the post.

In none of the embodiments shown in either the '207 or '820 patents is it possible to easily test the connections to the binding post without completely removing the cap from the post.

SUMMARY OF THE INVENTION

A cap for encapsulating terminals which have an extending threaded stud. The stud is for interconnecting one or more wires to the terminal.

The cap has a housing. The housing has a distal end and a proximal end and is sized to cover the terminal.

The cap also has a mechanism for engagement of the terminal stud threads. The mechanism is seated in the proximal end of the housing so as to be rotatable without causing rotation of the housing.

DESCRIPTION OF THE DRAWING

FIG. 2 shows the assembled cap prior to installation on the binding post.

FIG. 3 shows a terminal block with a multiplicity of installed caps.

FIG. 4*a* to 4*e* shows various views for an alternate embodiment for the cap.

DESCRIPTION OF THE PREFERRED EMBODIMENTS

Figure 1A:
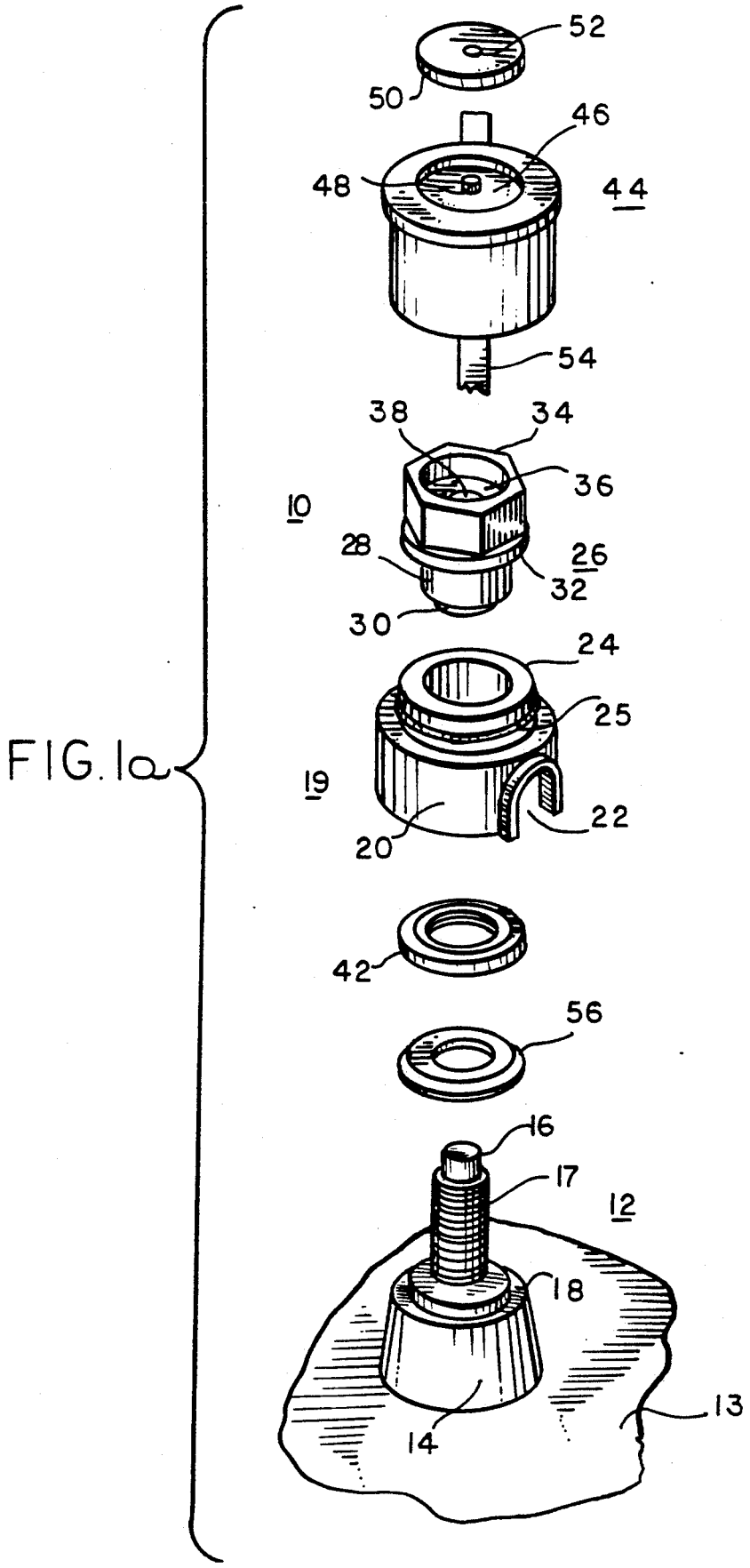
FIG. 1*a* shows an exploded perspective of the terminal locking cap of the present invention as well as one terminal of a terminal block.

Referring to the figures, there is shown in FIG. 1*a* an exploded perspective of the terminal locking cap 10 of the present invention as well as one terminal 12 of a terminal block 13. Terminal 12 typically includes a raised circular nonelectrical boss 14 extending upwardly from the terminal block, having a threaded binding post 16 extending axially therefrom. Binding post 16 also includes washerlike shoulder 18. A wire (not shown) can be connected to binding post 16 either by wrapping the wire around the post in a conventional manner or by providing the wire with a lug which can be slipped over the binding post. Prior to the present invention, the wire would be clamped to the binding post by one or more nuts or washers. A cap of the type shown either in the '207 or '820 patents would then be pressed on the binding post.

Figures 1B, 1C:
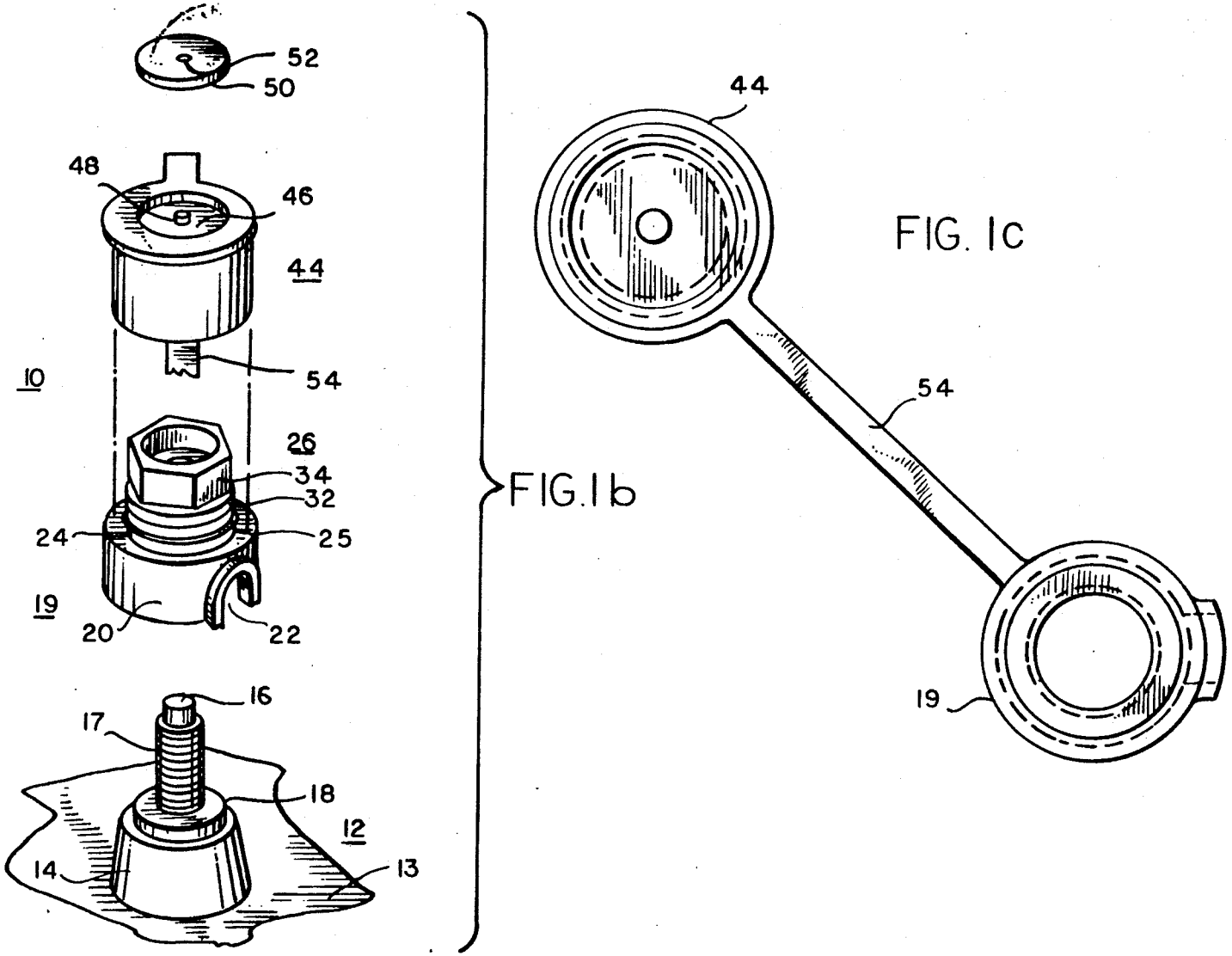
FIG. 1*b* shows the cap of FIG. 1*a* with the mechanism used to attach the cap to the binding post in assembled relationship to the cap's housing.
FIG. 1*c* shows a top view of the housing of the cap and a bottom view of the cap's cover.
Figure 4C:
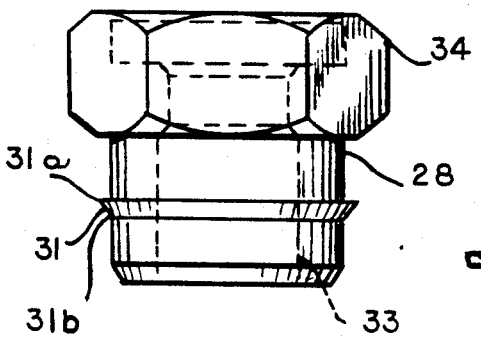
Figure 4D:
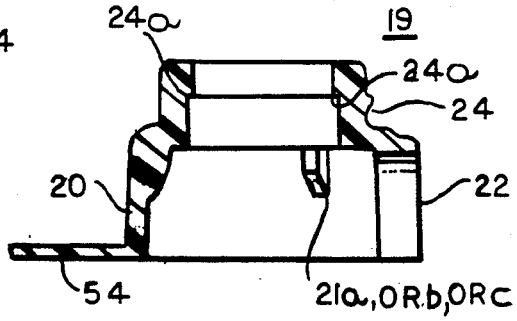
Figure 4E:
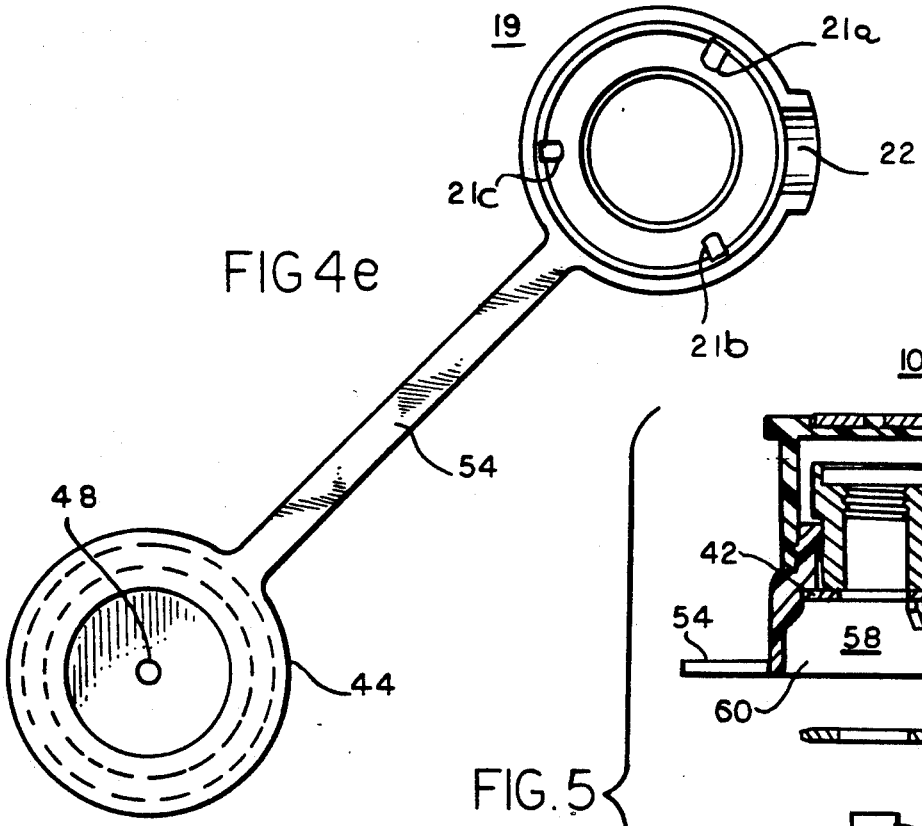

In contrast thereto, the cap 10 of the present invention is screwed onto the terminal binding post 16 with a suitable tool such as the standard 216 tool used in the telephone industry. The cap 10 is typically fabricated from an electrical insulator material and includes a housing 19 having a tubular body 20 which has an opening 22 therein opening to the distal end of the tubular body. The opening 22 enables wires to be connected to the post independent of the cap 10. At a proximal end of the tubular body is an integrally formed tubular neck 24. The neck has a smaller diameter than the tubular body. As shown in FIG. 1*b*, neck 24 includes ring 25. Seated in neck 24 is mechanism 26 which is used to place cap 10 on and off the binding post 16.

Mechanism 26 (see FIG. 2) is typically fabricated from an electrically conductive material and includes a first tubular body 28 which has at its distal end a second tubular body 30 integrally formed therewith. The diameter of tubular body 30 is less than the diameter of tubular body 28. At a proximal end of tubular body 28 is an integrally formed flange 32 and nut 34. Part way towards flange 32, the bottomside of nut 34 includes a surface 38*a*. An opening 38 extends downwardly from the surface 38*a* to the distal end of tubular body 30. Openings 36 and 38 are coaxial to screw thread 34. Screw thread 34 is complementary to the screw thread 17 on terminal binding post 16.

When mechanism 26 is inserted into the housing 19, the tubular body 30 extends into tubular body 20. Washer 42 having an inner diameter which is sufficient to fit over tubular body 30 is then assembled on tubular body 30 and the edge of tubular body 30 is upset to hold the washer 42 in place. When assembled the upset edge of tubular body 30 does not extend below the lower surface of washer 42. This ensures that it is only washer 42 which provides compression to any wire(s) wrapped on the post. Mechanism 26 can be rotated clockwise or counterclockwise without rotating either the housing 19 or washer 42.

Cap 10 also includes cover 44 in the form of a tubular body which is open at its distal end. Cover 44 includes groove 45. The diameter of the tubular body is sufficient to allow cover 44 to be placed over mechanism 26. Cover 44 is of sufficient length so that it entirely covers that part of mechanism 26 which projects above tubular neck 24 as well as the neck itself. Ring 25 and groove 45 interfit with each other to hold cover 44 in place. The proximal end of cover 44 (see FIG. 1*a*) includes a recess 46 which has a pin 48 for accepting a round color coded disc 50 having a hole 52 therein. Hole 52 is a press fit over pin 48. The color coded disc 50 may, for example, be colored red to indicate that a special circuit is connected to binding post 16.

Cover 44 may be attached to housing 19 by strap 54, only a portion of which is shown in FIG. 1*a*. Strap 54 is shown in its entirety in FIG. 1*c*. That figure shows a top view of housing 19 and a bottom view of cover 44.

Where two wires are connected to binding post 16, an additional washer 56 (shown in FIG. 1*a*) can be used. It should be noted that washer 56 is not part of mechanism 26.

FIG. 1*b* shows mechanism 16 in assembled relationship with housing 19, prior to installation on binding post 16. FIG. 3 shows a terminal block 13 having ten terminals with the cap of the present invention installed on each terminal binding post. As in the other figures, the circuit wires have been omitted for ease of illustration.

Installation of cap 10 on a binding post 16 involves the following steps:

1) aligning the cap so that the opening 22 is aligned over the wire(s) connected around the post;
2) using a suitable tool to rotate nut 34 clockwise so that the cap is securely tightened to the post 16; and
3) covering the top portion of mechanism 26 by engaging cover 44 over nut 34 and pressing to encircle housing 19.

Cap 10 can be removed from a binding post by disengaging cover 44 and rotating nut 34 counterclockwise with the suitable tool. When the cover 44 is disengaged, it remains permanently tethered to the housing by strap 54.

As can be seen in FIG. 2, the interior of body 20 includes a cavity 58 into which is disposed a water impermeable nontoxic, preferably electrically insulating, encapsulant 60. The encapsulant may be a grease or any other compound well known to those skilled in the art which has the above properties. When the cap 10 is properly installed on a binding post, encapsulant should protrude from the base of body 20 covering all uninsulated conductors. Some of the encapsulant should also protrude through the opening in nut 34. This ensures that the nut thread and binding post thread interface is also environmentally sealed.

There has been described above an embodiment for cap 10 of the present invention in which body 28 has at its proximal end an integral flange 32 and in which the edge of body 30 at the distal end is upset to hold washer 42 in place. Referring now to FIGS. 4*a* to 4*e*, there is shown an alternative embodiment for cap 10 in which flange 32 at the proximal end of body 28 has been eliminated and in which the edge of body 30 is not upset to hold washer 42 in place.

In this alternative embodiment, body 28 has closer to its distal end than its proximal end, a tapered flange 31 which protrudes outwardly from body 28 such that its upper edge 31*a* protrudes outwardly further from body 28 than does its lower edge 31*b* which is essentially flush with body 28 (see FIGS. 4*a*, b and c). When mechanism 26 is inserted in housing 19, it is this tapered flange 31 which interacts with an edge 24*a* internal to neck 24 (see FIG. 4*d*) to keep mechanism 26 is inserted in housing 19.

In this alternative embodiment (see FIG. 5), washer 42 is held in place by the encapsulant 60. During the assembly of cap 10, mechanism 26 is inserted in housing 19, washer 42 is then inserted in body 20 and encapsulant 60 is then inserted in body 20. In order to ensure that washer 42 is not lost prior to insertion of the encapsulant, housing 19 includes inside body 20 three inwardly protruding tabs 21*a*, 21*b* and 21*c*. These tabs are most clearly shown in FIG. 4*e*, which is a bottom view of the alternative embodiment for housing 19. These tabs are located near the proximal end of the inside of body 20.

Figure 5:
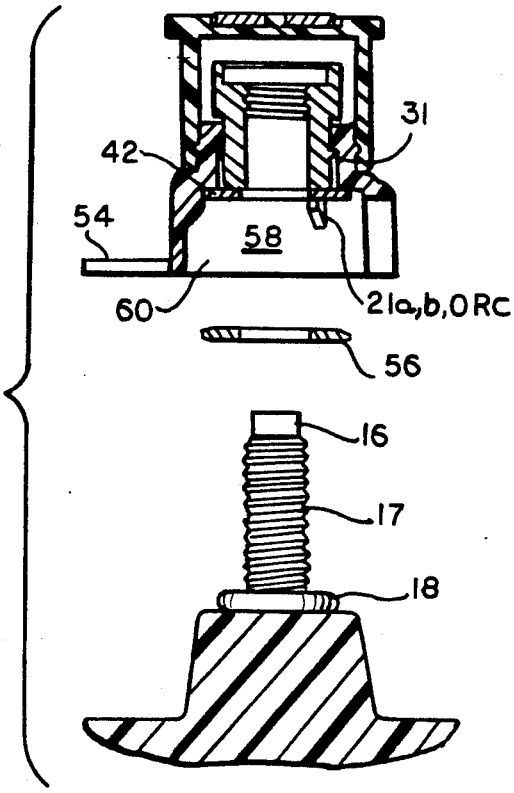
FIG. 5 shows the alternate embodiment for the cap fully assembled.

FIG. 5 shows the alternative embodiment for cap 10 fully assembled and is otherwise identical to cap 10 in FIG. 2.

It should be appreciated that as mechanism 26 is typically fabricated from an electrically conductive material, cap 10 allows test access to the terminal binding post without the necessity of removing the cap in its entirety from the post. All that is required to test the terminal after cap 10 has been installed is to remove cover 44 from mechanism 26. Upon completion of the test, the cover is replaced over the mechanism. It should be appreciated that the design of cap 10 is such as to allow some of the encapsulant 60 to environmentally seal the interface between the thread of nut 34 and the thread of binding post 16 as the cap is installed on the hindinq post.

It is to be understood that the description of the preferred embodiments are intended to be only illustrative, rather than exhaustive, of the present invention. Those of ordinary skill will be able to make certain additions, deletions, and/or modifications to the embodiments of the disclosed subject matter without departing from the spirit of the invention or its scope, as defined by the appended claims.

What is claimed is:

1. A cap for encapsulating a terminal having an extended threaded terminal stud, said cap comprising:

a) a nonconductive housing having a first end; a second end having an aperture, and an aperture open to said first end, said aperture of said first end configured and oriented for allowing said cap to encapsulate said terminal independent of any of one or more wires which pass through said aperture of said first end and are connected to said threaded terminal stud, said housing being sized to cover said terminal;

b) threaded engagement means for engaging said threaded terminal stud, said engagement means being captively rotatably seated in said aperture of said housing second end so as to be rotatable without causing rotation of said housing; and c) a nonconductive disengageable cover for said engagement means engageable with said housing for completely enclosing and covering said engagement means; said engagement means being rotatable without causing rotation of said cover; said cover being permanently tethered to said housing.

2. The cap of claim 1 wherein said housing comprises:

i) a tubular body sized to cover said terminal ii) a tubular neck connected to said tubular body second end, said engagement means seated in said tubular neck.

3. The cap of claim 1 wherein said engagement means is electrically conductive.

4. The cap of claim 2 wherein said engagement means is electrically conductive.

5. A cap for encapsulating a terminal having an extending threaded stud, said cap comprising:

a) a housing comprising:

i) a nonconductive tubular body having a first end, a second end and an aperture open to said tubular body first end, said aperture configured and oriented for allowing said cap to encapsulate said terminal independent of any of one or more wires which pass through said aperture and are connected to said threaded terminal stud, said first end being sized to cover said terminal; and ii) a tubular neck projecting outwardly from said tubular body at said second end;

b) threaded engagement means for engaging said threaded terminal stud, said engagement means being captively rotatable seated in said neck so as to be rotatable without causing rotation of said housing; and c) a nonconductive disengageable cover for said engagement means engageable with said housing for completely enclosing and covering said engagement means; said engagement means being rotatable without causing rotation of said cover; said cover being permanently tethered to said housing.

6. The cap of claim 5 wherein said engagement means is electrically conductive.

7. A method for encapsulating with a cap a terminal having an extending threaded stud, said cap having a housing with a first end, a second outwardly projecting end and a nonconductive aperture open to said first end said aperture configured and orients allowing said cap to encapsulate said terminal independently of any of one or more wires which pass through said aperture and are connected to said threaded terminal stud, said housing being sized to cover said terminal, and said cap also having threaded engagement means captively, rotatably seated in said housing second end so as to be rotatable without causing rotation of said body for engaging said threaded terminal stud, and a nonconductive disengageable cover for said engagement means engageable with said housing for completely enclosing and covering said engagement means; said engagement means being rotatable without causing rotation of said cover and said cover being permanently tethered to said housing, said method comprising the steps of:

a) aligning said housing with said terminal so that said nonconductive aperture is over any of said one or more wires connected to said terminal threaded stud and said threaded engagement means is engaged with said threaded terminal stud;

b) rotating said engagement means until said cap is securely tightened to said terminal, and c) engaging said cover with said housing to completely enclose and cover said engagement means.

* * * * *